US008419349B2

(12) United States Patent
Rivas Cortes et al.

(10) Patent No.: US 8,419,349 B2
(45) Date of Patent: Apr. 16, 2013

(54) STEAM TURBINE AND SYSTEM FOR START-UP

(75) Inventors: Flor del Carmen Rivas Cortes, Clifton Park, NY (US); William Thomas Parry, Rexford, NY (US)

(73) Assignee: General Electric Company, Schenectady, NY (US)

( * ) Notice: Subject to any disclaimer, the term of this patent is extended or adjusted under 35 U.S.C. 154(b) by 917 days.

(21) Appl. No.: 12/539,780

(22) Filed: Aug. 12, 2009

(65) Prior Publication Data

US 2011/0038711 A1 Feb. 17, 2011

(51) Int. Cl.
*F01D 3/02* (2006.01)

(52) U.S. Cl.
USPC ..... 415/94; 415/102; 415/116; 415/145

(58) Field of Classification Search ..... 415/93, 415/94, 95, 101, 102, 103, 108, 116, 117, 415/145; 60/670, 676
See application file for complete search history.

(56) References Cited

U.S. PATENT DOCUMENTS 968,839 A * 8/1910 Ehrhart ..... 415/107
5,412,936 A 5/1995 Lee et al.

* cited by examiner

*Primary Examiner* — Edward Look
*Assistant Examiner* — Jason Davis
(74) *Attorney, Agent, or Firm* — Ernest G. Cusick; Hoffman Warnick LLC

(57) ABSTRACT

A steam turbine and a start-up system for a steam turbine are disclosed comprising: a plurality of stages, a steam path through the plurality of stages, an inlet port for introducing steam to a first stage, an exhaust port at a last stage for allowing exhaust to exit the steam turbine, an admission port for allowing steam to enter the steam path at a location downstream from the inlet port, and a ventilator port for allowing steam to exit the steam path, the ventilator port located upstream of the admission port to create a reverse flow of steam towards the ventilator port from the admission port.

16 Claims, 1 Drawing Sheet

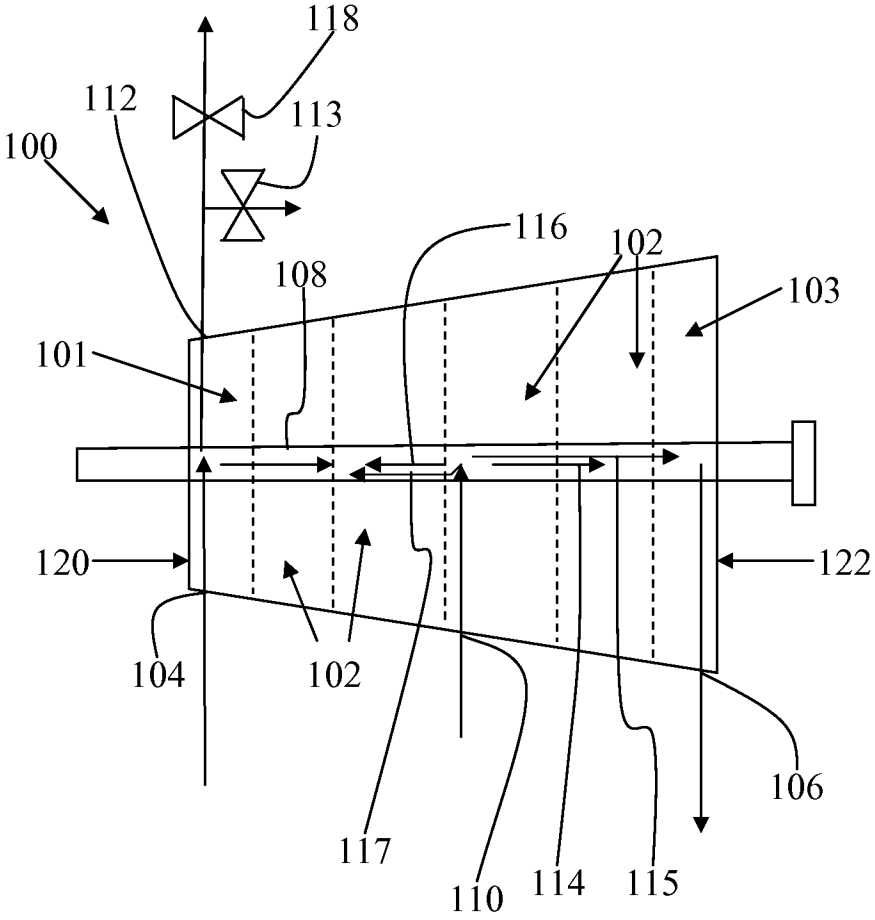
100
112
118
113
101
108
116
102
103
120
104
102
117
110
114
115
106
122

STEAM TURBINE AND SYSTEM FOR START-UP

BACKGROUND OF THE INVENTION

The subject matter disclosed herein relates generally to steam turbines and a start-up system for steam turbines. More specifically, the present invention relates to allowing steam to enter a steam path of a steam turbine at an admission port to facilitate start-up of the steam turbine.

BRIEF DESCRIPTION OF THE INVENTION

A steam turbine and a start-up system for a steam turbine are disclosed comprising: a plurality of stages, a steam path through the plurality of stages, an inlet port for introducing steam to a first stage, an exhaust port at a last stage for allowing exhaust to exit the steam turbine, an admission port for allowing steam to enter the steam path at a location downstream from the inlet port, and a ventilator port for allowing steam to exit the steam path, the ventilator port located upstream of the admission port to create a reverse flow of steam towards the ventilator port from the admission port.

A first aspect of the invention provides a steam turbine comprising: a plurality of stages; a steam path through the plurality of stages; an inlet port for introducing steam to a first stage; an exhaust port at a last stage for allowing exhaust to exit the steam turbine; an admission port for allowing steam to enter the steam path at a location downstream from the inlet port; and a ventilator port for allowing steam to exit the steam path, the ventilator port located upstream of the admission port to create a reverse flow of steam towards the ventilator port from the admission port.

A second aspect of the invention provides a start-up system for a steam turbine having a plurality of stages and a steam path through the plurality of stages, the start-up system comprising: an inlet port for introducing steam to a first stage; an exhaust port at a last stage for allowing exhaust to exit the steam turbine; an admission port for allowing steam to enter the steam path at a location downstream from the inlet port; and a ventilator port for allowing steam to exit the steam path, the ventilator port located upstream of the admission port to create a reverse flow of steam towards the ventilator port from the admission port.

BRIEF DESCRIPTION OF THE DRAWING

These and other features of the disclosure will be more readily understood from the following detailed description of the various aspects of the invention taken in conjunction with the accompanying drawing that depict various aspects of the invention, in which:

FIG. 1 shows a schematic of a steam turbine in one embodiment of the invention including the movement of steam.

It is noted that the drawing is not to scale. The drawing is intended to depict only typical aspects of the invention, and therefore should not be considered as limiting the scope of the invention.

DETAILED DESCRIPTION OF THE INVENTION

As indicated above, aspects of the invention relate to a steam turbine and a start-up system for a steam turbine. Moreover, the subject matter relates to a start-up process of a steam turbine that more efficiently utilizes steam and provides improved starting and loading capability. In operating a steam turbine, it is advantageous to avoid excessive temperature at the last stage of a steam turbine during start-up, and hence the use of expensive materials. The ability to have steam enter the steam turbine and the steam path in a location other than an inlet port in a first stage of the steam turbine results in more steam flow required to overcome start-up losses, and hence a lower temperature at the last stage.

Turning to the drawing, FIG. 1 illustrates a schematic of a steam turbine 100. FIG. 1 also illustrates steam flow movement within steam turbine 100. Steam turbine 100 may be one of a condensing steam turbine or a non-condensing steam turbine. Steam turbine 100 includes a plurality of stages 102, which turn a rotating shaft to produce electricity as steam passes through plurality of stages 102. Steam path 108 may extend through plurality of stages 102.

Steam turbine 100 includes an inlet port 104 connected to a first stage 101 to introduce steam to first stage 101. From first stage 101, steam moves through steam path 108 into plurality of stages 102. Steam that enters steam path 108 from first stage 101 provides the steam that operates steam turbine 100 and produces electricity. The steam that enters through inlet port 104 moves through first stage 101 and then plurality of stages 102 in a forward flow 114. Forward flow 114 refers to the direction of steam that enters steam turbine 100 through inlet port 104 and moves towards exhaust port 106 through steam path 108. In other words, forward flow 114 refers to the movement of steam from an upstream region 120 towards a downstream region 122.

Steam turbine 100 has an exhaust port 106 at a last stage 103 of steam turbine 100. Exhaust port 106 is where pressurized exhaust from the production of electricity in steam turbine 100 exits steam path 108 after moving through plurality of stages 102 and last stage 103.

Steam turbine 100 may also have an admission port 110. Admission port 110 may be located downstream from inlet port 104 and allows steam to enter steam path 108. Steam that enters steam path 108 through admission port 110 may move towards upstream region 120 and/or towards downstream region 122 of steam turbine 100.

Steam turbine 100 may also have a ventilator port 112. Ventilator port 112 may be used to allow steam to exit steam path 108. Ventilator port 112 may be located upstream of admission port 110 and may be at the location of inlet port 104. Ventilator port 112 may be used to create a reverse flow of steam towards ventilator port 112 from admission port 110. Steam turbine 100 may also have a ventilator valve 113. Ventilator valve 113 may be coupled to ventilator port 112 and regulate the steam temperature and steam pressure in steam path 108 upstream of admission port 110. Moreover, steam turbine 100 may have a control valve 118. Control valve 118 may connect into steam path 108. Ventilator valve 113 and control valve 118 may both connect into steam path 108 at the same location. Control valve 118 may be used to regulate steam flow and pressure in steam path 108. Moreover, control valve 118 may also be used to stop operation of steam turbine 100.

As discussed herein, steam that enters inlet port 104 may be used to produce electricity in steam turbine 100. That is, as steam enters inlet port 104 it introduces steam to first stage 101. From first stage 101, steam moves through steam path 108 to reach plurality of stages 102. From plurality of stages 102, steam enters last stage 103 through steam path 108 and then exits steam turbine 100 through exhaust port 106.

Start-up of steam turbine 100 may occur by steam entering inlet port 104 or admission port 110. As discussed herein, steam entering admission port 110 may provide improved start-up of steam turbine 100 as it will require more flow to overcome start-up losses, and hence results in a lower last stage 103 temperature.

As steam from admission port 110 enters steam path 108, a portion of steam 115 moves towards downstream region 122 of steam turbine 100. As portion of steam 115 from admission port 110 moves through plurality of stages 102 in forward flow 114 and downstream of admission port 110, portion of steam 115 may be able to produce enough electricity to overcome start-up losses. Portion of steam 115 from admission port 110 can produce electricity as the steam moves through plurality of stages 102 downstream of admission port 110 in forward flow 114.

Steam 117 from admission port 110 may also enter steam path 108 and move towards upstream region 120 of steam turbine 100. As steam 117 from admission port 110 moves through plurality of stages 102 and upstream of admission port 110, steam 117 may be cooler than the steam entering through inlet port 104. The cooler steam temperature at admission port 110 allows for improved loading in plurality of stages 102 upstream of admission port 110. In other words, as steam 117 from admission port 110 moves upstream it may provide a reverse flow 116 of steam 117 to aid in maintaining a steam temperature and pressure in plurality of stages 102 to maintain a preferred steam temperature during start-up.

In a further embodiment, ventilator valve 113 will be coupled to ventilator port 112 and ventilator valve 113 will regulate the volume of steam 117 that exits steam path 108 through ventilator port 112. Specifically, ventilator valve 113 will regulate the volume, temperature and pressure of steam 117 in steam path 108 that originated from admission port 110 and is providing reverse flow 116 to plurality of stages 102 upstream of admission port 110. By ventilator valve 113 regulating the volume of steam 117 that exits steam path 108 (i.e., through ventilator port 112) and that originated from admission port 110, a preferred steam pressure and temperature can be maintained in steam path 108.

In one embodiment, ventilator valve 113 may be calibrated based on a number of factors to aid in maintaining a predetermined steam pressure and temperature in steam path 108. Factors that may be used in the calibration of ventilator valve 113, as an example, include: maximum recommended temperature of steam at inlet port 104, maximum recommended temperature at exhaust port 106, recommended operating steam pressure of steam turbine 100 and known drop in steam temperature and pressure as steam moves from inlet port 104 towards exhaust port 106 and through plurality of stages 102 in forward flow 114. Ventilator valve 113 may contribute to regulating the temperature and pressure of steam 117 in steam path 108 by controlling the steam's reverse flow 116 from admission port 110 to ventilator port 112. As an example, ventilator valve 113 may be calibrated for greater steam release if the temperature of steam path 108 exceeds a threshold level. Conversely, ventilator valve 113 may be calibrated for reduced steam release if the pressure of steam path 108 falls below a threshold level.

In an alternative embodiment, there may be steam turbine 100 where the admission port 110 includes a plurality of admission ports (not shown). Furthermore, there may be a steam turbine 100 where the exhaust port 106 includes a plurality of exhaust ports (not shown). In this embodiment, each of the one or more admission ports and/or exhaust ports will operate substantially as described herein.

In a further embodiment, there may be a start-up system for steam turbine 100. Start-up system may operate significantly similar to steam turbine 100 described herein. Furthermore, start-up system may comprise a retrofit that can be applied to any existing steam turbine.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A steam turbine comprising:

a plurality of stages;

a steam path through the plurality of stages;

an inlet port for introducing steam to the steam path in a first stage;

an exhaust port at a last stage for allowing exhaust to exit the steam path of the steam turbine;

an admission port for allowing steam to enter the steam path at a location downstream from the inlet port; and a ventilator port for allowing steam to exit the steam path, the ventilator port located upstream of the admission port to create a reverse flow of steam towards the ventilator port from the admission port.

2. The steam turbine of claim 1, wherein the admission port allows steam to enter the steam path during steam turbine start-up, and wherein steam from the admission port produces electricity in the plurality of stages downstream of the admission port.

3. The steam turbine of claim 1, wherein steam from the inlet port produces electricity in the plurality of stages downstream of the inlet port.

4. The steam turbine of claim 1, wherein steam entering the steam path through the admission port is cooler than the steam entering through the inlet port.

5. The steam turbine of claim 1, further comprising a ventilator valve coupled to the ventilator port for regulating a steam temperature and a steam pressure in the steam path upstream of the admission port, wherein the ventilator valve regulates the reverse flow of steam towards the ventilator port from the admission port.

6. The steam turbine of claim 1, wherein the admission port includes a plurality of admission ports.

7. The steam turbine of claim 1, wherein the exhaust port includes a plurality of exhaust ports, and wherein the exhaust includes at least one of: steam from the admission port or steam from the inlet port.

8. The steam turbine of claim 1, wherein the steam turbine is one of a condensing steam turbine or a non-condensing steam turbine.

9. A start-up system for a steam turbine having a plurality of stages and a steam path through the plurality of stages, the start-up system comprising:

an inlet port for introducing inlet steam to a first stage of the steam path;

an exhaust port at a last stage for allowing exhaust to exit the steam turbine;

an admission port for allowing admission steam to enter the steam path at a location downstream from the inlet port; and a ventilator port for allowing admission steam and inlet steam to exit the steam path, the ventilator port located upstream of the admission port to create a reverse flow of admission steam towards the ventilator port from the admission port.

10. The start-up system of claim 9, wherein admission steam from the admission port produces electricity in the plurality of stages downstream of the admission port, and wherein at least one of a pressure of the admission steam or a temperature of the admission steam is varied relative to the inlet steam.

11. The start-up system of claim 9, wherein inlet steam from the inlet port produces electricity in the plurality of stages downstream of the inlet port, and wherein at least one of a pressure or a temperature of the inlet steam and the admission steam vary relative to one another during steam turbine start-up.

12. The start-up system of claim 9, wherein steam entering the steam path through the admission port is cooler than the steam entering through the inlet port.

13. The start-up system of claim 9, further comprising a ventilator valve coupled to the ventilator port for regulating a steam temperature and a steam pressure in the steam path upstream of the admission port.

14. The start-up system of claim 9, wherein the admission port includes a plurality of admission ports.

15. The start-up system of claim 9, wherein the exhaust port includes a plurality of exhaust ports.

16. The start-up system of claim 9, wherein the steam turbine is one of a condensing steam turbine or a non-condensing steam turbine.

* * * * *